US010847084B2

(12) United States Patent
Xue

(10) Patent No.: US 10,847,084 B2
(45) Date of Patent: Nov. 24, 2020

(54) DISPLAY CONTROL METHOD AND SYSTEM FOR DISPLAY SCREEN

(71) Applicant: HUAQIN TELECOM TECHNOLOGY CO., LTD., Shanghai (CN)

(72) Inventor: Baijin Xue, Shanghai (CN)

(73) Assignee: HUAQIN TELECOM TECHNOLOGY CO., LTD., Shanghai (CN)

( * ) Notice: Subject to any disclaimer, the term of this patent is extended or adjusted under 35 U.S.C. 154(b) by 0 days.

(21) Appl. No.: 16/693,044

(22) Filed: Nov. 22, 2019

(65) Prior Publication Data

US 2020/0090582 A1 Mar. 19, 2020

Related U.S. Application Data

(63) Continuation of application No. PCT/CN2017/113518, filed on Nov. 29, 2017.

(30) Foreign Application Priority Data

Oct. 19, 2017 (CN) ..... 2017 1 0980164

(51) Int. Cl.
*G09G 3/32* (2016.01)
*G09G 5/14* (2006.01)

(52) U.S. Cl.
CPC ..... *G09G 3/32* (2013.01); *G09G 5/14* (2013.01); *G09G 2380/02* (2013.01)

(58) Field of Classification Search
CPC combination set(s) only.
See application file for complete search history.

(56) References Cited

FOREIGN PATENT DOCUMENTS

CN 104461442 A 3/2015
CN 106502602 A 3/2017

OTHER PUBLICATIONS

Notification of the First Examination Report dated Jun. 5, 2019 in connection with CN 201710980164.9 (with English translation).
International Search Report (ISR) dated Jul. 25, 2018 for Application No. PCT/CN2017/113518.
English abstract of CN 106502602.
English abstract of CN 104461442.

*Primary Examiner* — Charles V Hicks
(74) *Attorney, Agent, or Firm* — Ladas & Parry LLP

(57) ABSTRACT

Disclosed in the present invention are a display control method and system for a display screen. The display screen is a flexible display screen, and multiple light-emitting diodes are disposed on the flexible display screen. The display control method for a display screen comprises: detecting whether a display screen is bent when all the multiple light-emitting diodes emit light to display; and turning off some of the light-emitting diodes to keep a display image consistent before and after the display screen is bent if the display screen is bent. In the display control method and system for a display screen in the present invention, when the flexible screen is bent in a forward direction or a backward direction, the light-emitting diodes are controlled to normally display images without partial stretch, contraction or other phenomena, thereby improving user experience.

10 Claims, 6 Drawing Sheets

DISPLAY CONTROL METHOD AND SYSTEM FOR DISPLAY SCREEN

CROSS REFERENCE TO RELATED APPLICATIONS

The present disclosure is a continuation of international application No. PCT/CN2017/113518 filed on Nov. 29, 2017, and titled "DISPLAY CONTROL METHOD AND SYSTEM FOR DISPLAY SCREEN", which is incorporated herein by reference in its entirety. The PCT application is based on the Chinese patent application No. CN201710980164.9, filed on Oct. 19, 2017, which is incorporated herein by reference in its entirety.

TECHNICAL FIELD

The present disclosure relates to screen control, and in particular, to a display control method and system for a display screen.

BACKGROUND

With the development of the electronic technology, more and more functions can be realized by electronic devices such as a mobile phone and a tablet computer. A user can watch an image, a video, read an e-book or play an online game through a display screen of an electronic device.

A curved display screen is available in existing technologies, and the curved display screen is a bendable flexible screen.

With the development of the curved display screen technology, various curved electronic devices are gradually emerging in people's lives. The curved electronic device is such a device as bending its body and screen as required by a user.

When bending a flexible screen forward or backward upon watching a video on the flexible screen, a display image may stretch or contract as the screen bends forward or backward.

SUMMARY

The present disclosure aims to provide a display control method and system for the display screen so as to overcome a defect of an abnormal image due to a stretch or a contraction of the image when bending a flexible screen forward or backward in the existing technology.

The present disclosure solves the above technical problem through the following technical solution.

A display control method for a display screen is provided, the display screen is a flexible display screen provided with multiple light-emitting diodes, and the display control method for the display screen including:

detecting whether the display screen is bent when all the multiple light-emitting diodes emit light to display; and turning off some of the light-emitting diodes if the display screen is bent, to keep a display image consistent before and after the display screen is bent.

Alternatively, two infrared modules are disposed at two opposite edges of the display screen, and a line direction of the two infrared modules is identical with a bending direction of the display screen.

After the step of detecting that the display screen is bent and before the step of turning off some of the light-emitting diodes, the display control method further includes:

calculating a bending angle of the display screen via the two infrared modules;

judging whether the bending angle is greater than a preset value, and executing the step of turning off some of the light-emitting diodes if the bending angle is greater than the preset value.

Alternatively, the step of calculating the bending angle of the display screen includes:

acquiring a first distance between the two infrared modules before the display screen is bent;

acquiring a second distance between the two infrared modules after the display screen is bent;

calculating the bending angle of the display screen by taking the first distance as a first arc length and the second distance as a first chord length.

Alternatively, the display screen is further provided with multiple infrared modules in the line direction of the two infrared modules.

The step of turning off some of the light-emitting diodes includes:

acquiring a target distance between a first light-emitting diode and a second light-emitting diode that are located between a first infrared module and a second infrared module;

detecting whether there is a target light-emitting diode on the display screen, and turning off the second light-emitting diode when there is not a target light-emitting diode on the display screen, where a distance between the target light-emitting diode and the first light-emitting diode before the display screen is bent is the target distance;

the first infrared module and the second infrared module are any two infrared modules on the display screen;

the first light-emitting diode and the second light-emitting diode are any two light-emitting diodes between the first infrared module and the second infrared module.

Alternatively, the step of acquiring the target distance between the first light-emitting diode and the second light-emitting diode includes:

establishing a rectangular coordinate system;

acquiring a first coordinate of the first infrared module and a first coordinate of the second infrared module in the rectangular coordinate system, an initial distance before the display screen is bent, and a final distance after the display screen is bent;

acquiring a circle equation of a curved surface where the first infrared module and the second infrared module are located, via the initial distance which is taken as a second arc length, the final distance which is taken as a second chord length, and the first coordinates;

acquiring a second coordinate of the first light-emitting diode and a second coordinate of the second light-emitting diode in the rectangular coordinate system via the circle equation;

calculating the target distance according to the second coordinate of the first light-emitting diode and the second coordinate of the second light-emitting diode.

Alternatively, the display screen is controlled to perform split-screen display if the bending angle of the display screen is not greater than the preset value.

Alternatively, the step of controlling the display screen to perform split-screen display includes:

acquiring a placing direction of the display screen via a gravity sensor;

dividing the display screen into a first split screen and a second split screen in the placing direction;

setting the first split screen as a primary screen and the second split screen as a secondary screen.

A display control system for a display screen is provided, where the display screen is a flexible display screen provided with multiple light-emitting diodes, and the display control system for the display screen including a detecting unit and a control unit;

The detecting unit is configured to detect whether the display screen is bent when all the multiple light-emitting diodes emit light to display, and call the control unit if the display screen is bent.

The control unit is configured to turn off some of the light-emitting diodes to keep a display image consistent before and after the display screen is bent.

Alternatively, two infrared modules are disposed at two opposite edges of the display screen, and a line direction of the two infrared modules is identical with a bending direction of the display screen;

The display control system for the display screen further includes a bending angle acquisition unit and a bending angle judging unit.

The bending angle acquisition unit is called after the display control system for the display screen calls the detecting unit and before the display control system for the display screen calls the control unit.

The bending angle acquisition unit is configured to calculate the bending angle of the display screen via the two infrared modules.

The curving angle judging unit is configured to judge whether the bending angle is greater than a preset value, and to call the control unit if the bending angle is greater than a preset value.

Alternatively, the curving angle acquisition unit including a distance acquisition module and a bending angle calculation module.

The distance acquisition module is configured to acquire a first distance between the two infrared modules before the display screen is bent.

The distance acquisition module is further configured to acquire a second distance between the two infrared modules after the display screen is bent.

The bending angle calculation module is configured to calculate a bending angle of the display screen by taking the first distance as a first are length and the second distance as a first chord length.

Alternatively, the display screen is further provided with multiple infrared modules in the line direction of the two infrared modules.

The control unit includes a target distance acquisition module and a detection turn-off module.

The target distance acquisition module is configured to acquire a target distance between a first light-emitting diode and a second light-emitting diode that are located between a first infrared module and a second infrared module;

The detection turn-off module is configured to detect whether there is a target light-emitting diode on the display screen, and to turn off the second light-emitting diode when there is not a target light-emitting diode on the display screen, where a distance between the target light-emitting diode and the first light-emitting diode before the display screen is bent is the target distance.

The first infrared module and the second infrared module are any two infrared modules on the display screen.

The first light-emitting diode and the second light-emitting diode are any two light-emitting diodes between the first infrared module and the second infrared module.

Alternatively, the target distance acquisition module includes a coordinate calculation submodule, a distance acquisition submodule, a circle equation acquisition submodule, and a target distance calculation submodule.

The coordinate calculation submodule is configured to establish a rectangular coordinate system;

The coordinate calculation submodule is further configured to acquire a first coordinate of the first infrared module and a first coordinate of the second infrared module in the rectangular coordinate system.

The distance acquisition submodule is configured to acquire an initial distance between the first infrared module and the second infrared module before the display screen is bent and a final distance between the first infrared module and the second infrared module after the display screen is bent;

The circle equation acquisition submodule is configured to acquire a circle equation of a curved surface where the first infrared module and the second infrared module are located, via the initial distance which is taken as a second arc length, the final distance which is taken as a second chord length and the first coordinates.

The coordinate calculation submodule is further configured to acquire a second coordinate of the first light-emitting diode and a second coordinate of the second light-emitting diode in the rectangular coordinate system via the circle equation.

The target distance calculation submodule is configured to calculate the target distance according to the second coordinate of the first light-emitting diode and the second coordinate of the second light-emitting diode.

Alternatively, the display control system for the display screen further includes a split-screen unit.

The bending angle judging unit is further configured to call the split-screen unit if the bending angle of the display screen is not greater than the preset value;

The split-screen unit is configured to control the display screen to perform split-screen display.

Alternatively, the split-screen unit includes a placing direction acquisition module and a split-screen setting module.

The placing direction acquisition module is configured to acquire a placing direction of the display screen via a gravity sensor.

The split-screen setting module is configured to divide the display screen into a first split screen and a second split screen in the placing direction.

The split-screen setting module is further configured to set the first split screen as a primary screen and the second split screen as a secondary screen.

On the basis of common knowledge in the art, the forgoing preferred conditions may be combined arbitrarily to acquire various preferred examples of the present disclosure.

An advantage of the present disclosure is to control the operation of the light-emitting diode when the flexible screen is bent forward or backward, to enable an image to be normally displayed without a partial stretch or contraction, thereby improving user experience.

DETAILED DESCRIPTION

The present disclosure is further described below by way of embodiments, but the present disclosure is not therefore limited to the scope of the described examples.

A First Embodiment

Figure 1:
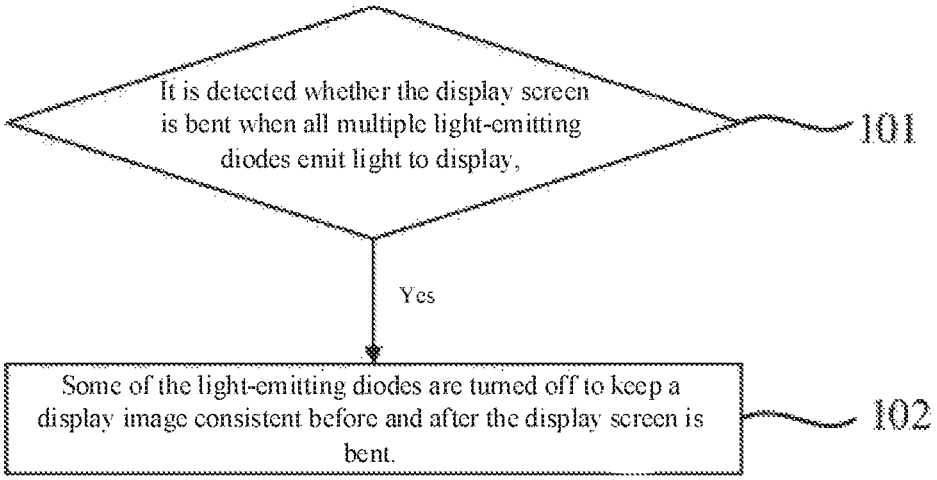
FIG. 1 is a flowchart of a display control method for a display screen according to a first embodiment of the present disclosure.

FIG. 1 shows a flowchart of a display control method for a display screen according to this embodiment. The display screen is a flexible display screen provided with multiple light-emitting diodes, and the display control method for the display screen including the following steps.

In step 101, it is detected whether the display screen is bent when all the multiple light-emitting diodes emit light to display.

The flexible display screen is provided with multiple light-emitting diodes, an initial state of the display screen is horizontal, and the display screen is provided with a pressure sensor. The pressure sensor judges whether the display screen is bent by sensing a pressure of each position point on the display screen. If the display screen is bent, step 102 is implemented, and if not, the light-emitting diodes are kept emitting light normally to display.

In step 102, some of the light-emitting diodes are turned off to keep a display image consistent before and after the display screen is bent.

In this embodiment, the display control method for the display screen is to turn off some of the light-emitting diodes to keeps the display image on the display screen consistent before and after the display screen is bent without a partial stretch or contraction, thereby improving user experience.

A Second Embodiment

Figure 2:
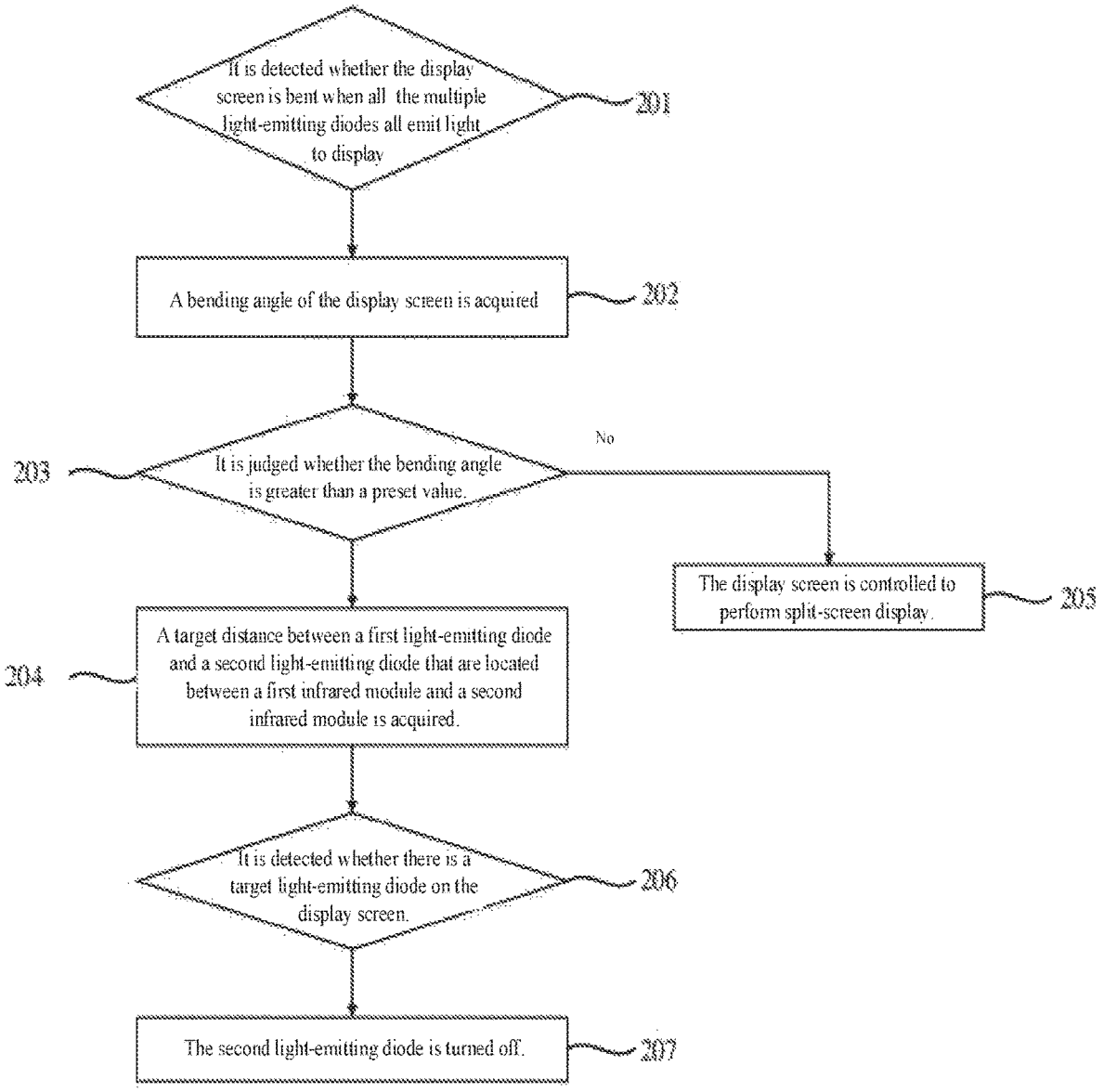
FIG. 2 is a flowchart of a display control method for a display screen according to a second embodiment of the present disclosure.

FIG. 2 shows a flowchart of a display control method for a display screen according to this embodiment. In this embodiment, the step of turning off some of the light-emitting diodes is described specifically on the basis of the first embodiment. A screen bending includes a forward bending and a backward bending. In this embodiment, the forward bending is taken as an example. The display control method for the backward bending is the same as for the forward bending, and thus is not repeated herein.

In step 201, it is detected whether the display screen is bent when all the multiple light-emitting diodes emit light to display.

Step 201 is the same as step 101 in the first embodiment, and thus is not repeated herein.

If the display screen is bent, step 202 is implemented, and if not, the light-emitting diodes are kept emitting light normally to display.

In step 202, a bending angle of the display screen is acquired.

Two infrared modules are disposed at two opposite edges of the display screen, and a line direction of the two infrared modules is identical with a bending direction of the display screen. The bending angle of the display screen is calculated via the two infrared modules.

Figure 4A:
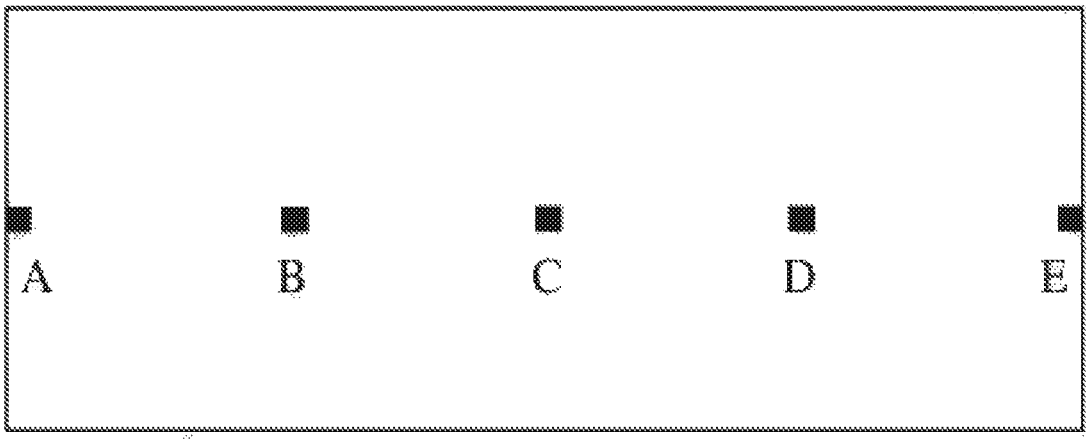
FIG. 4*a* is a schematic diagram of a display screen before it is bent in the present disclosure.

Specifically, as shown in FIG. 4*a*, five infrared modules, A, B, C, D and E, are disposed on the display screen before the screen is bent, where A and E are two infrared modules disposed at two opposite edges. In this embodiment, multiple infrared modules are disposed equidistantly in the line direction of the two infrared modules disposed at the two opposite edges. Therefore, the five infrared modules are respectively disposed at the left edge, the middle portion of the left half, the center portion, the middle portion of the right half, and the right edge of the display screen and are on the same straight line.

In this embodiment, the bending angle of the display screen is acquired by the infrared modules A and E.

Figure 4B:
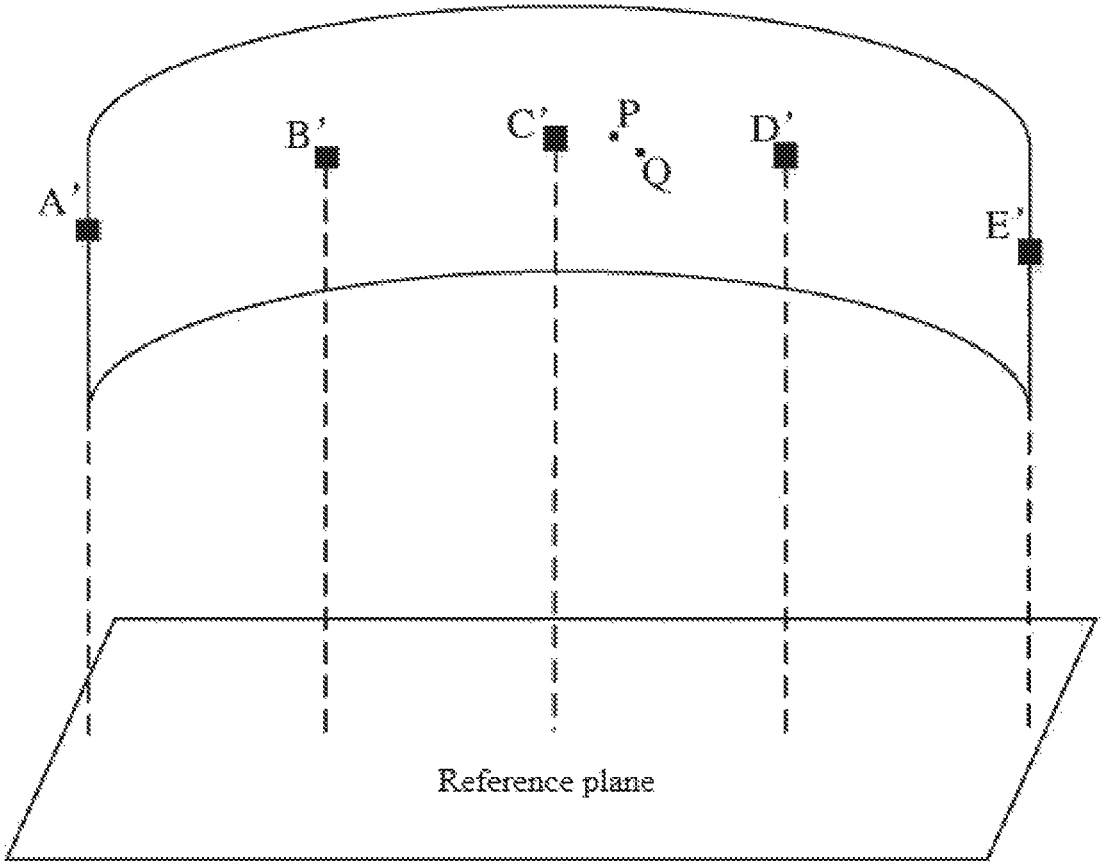
FIG. 4*b* is a schematic diagram of the display screen after it is bent in the present disclosure.

Specifically, as shown in FIG. 4*a* and FIG. 4*b*, it should be explained in advance that the five infrared modules A', B', C', D' and E' shown in FIG. 4*b* are respectively corresponding to the five infrared modules A, B, C, D and E after the display screen is bent.

A first distance between the infrared modules A and E before the display screen is bent and a second distance between the infrared modules A' and E' after the display screen is bent may be respectively acquired via the infrared modules A and E.

The bending angle of the display screen is calculated by taking the first distance as a first arc length and the second distance as a first chord length.

The first arc length is defined as 1, the first chord length is defined as a, and the bending angle θ is calculated according to formula (1).

Herein, r is the radius of the circle where the first arc length is located.

$$\begin{cases} \sin\frac{\theta}{2} = \frac{a/2}{r} \\ 1 = \theta r \end{cases} \tag{1}$$

In step 203, it is judged whether the bending angle is greater than a preset value.

By comparing the bending angle of the display screen with the preset value, the preset value in this embodiment is 130°. If the bending angle is greater than 130°, step 204 is implemented, and if the bending angle is less than or equal to 130°, step 205 is implemented.

In step 204, a target distance between a first light-emitting diode and a second light-emitting diode that are located between a first infrared module and a second infrared module is acquired. Then step 206 is implemented.

The first infrared module and the second infrared module are any two infrared modules on the display screen, and the first light-emitting diode and the second light-emitting diode are any two light-emitting diodes between the first infrared module and the second infrared module.

Figure 3:
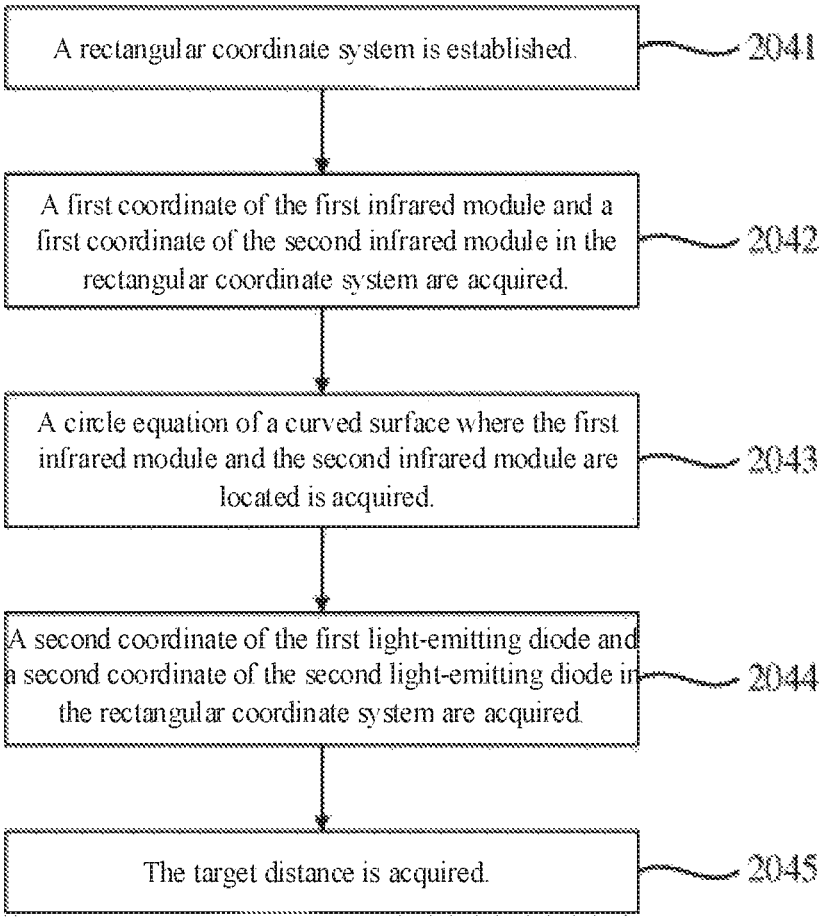
FIG. 3 is a flowchart for acquiring a target distance in the display control method for the display screen according to the second embodiment of the present disclosure.

As shown in FIG. 3, step 204 is specifically divided into the following steps.

In step 2041, a rectangular coordinate system is established.

An x-axis is a straight line connecting the first infrared module and the second infrared module before the display screen is bent, a y-axis is a straight line perpendicular to the display screen, and an origin is the first infrared module before the display is bent.

As shown in FIG. 4*a* and FIG. 4*b*, in this embodiment, C and D are selected as the first infrared module and the second infrared module. It is supposed that there are any two light-emitting diodes between the first infrared module C and the second infrared module D, P is the first light-emitting diode, and Q is the second light-emitting diode.

Since the first light-emitting diode P and the second light-emitting diode Q are located on a curved surface where the first infrared module C' and the second infrared module D' are located, the x-axis is a straight line connecting the first infrared module C and the second infrared module D before the display screen is bent, the y-axis is the straight line perpendicular to the display screen, and the origin is the first infrared module C before the display screen is bent.

In step 2042, a first coordinate of the first infrared module and a first coordinate of the second infrared module in the rectangular coordinate system are acquired.

The step is to acquire the first coordinate of the first infrared module C' and the first coordinate of the second infrared module D' in the rectangular coordinate system after the display screen is bent.

Since the first infrared module C is the origin of the rectangular coordinate system and the first infrared module C' is set on the y-axis, the first coordinate of the first infrared module C' may be acquired.

A plane before the display screen is bent is taken as a reference plane to acquire heights of the first infrared module C' and the second infrared module D' relative to the reference plane after the display screen is bent.

Therefore, an abscissa of the first infrared module C' is 0, and an ordinate of the first infrared module C' is the height of the first infrared module C' relative to the reference plane.

Then a height difference between the first infrared module C' and the second infrared module D' is acquired according to the height.

A final distance between the first infrared module C' and the second infrared module D' after the display screen is bent may be acquired via these two infrared modules C' and D'. The final distance is taken as a second chord length.

The height difference is taken as a right-angle edge and the second chord length is taken as a bevel edge to acquire a length of the other right-angle edge, i.e., a distance of the second infrared module D' from the y-axis. The first coordinate of the second infrared module D' may be acquired according to the rectangular coordinate system, x coordinate is the distance of the second infrared module D' from the y-axis, and y coordinate is the height of the second infrared module D' relative to the reference plane.

In step 2043, a circle equation of a curved surface where the first infrared module and the second infrared module are located is acquired.

This step is to acquire the circle equation of the curved surface where the first infrared module C' and the first infrared module D' are located.

An initial distance between the first infrared module and the second infrared module before the display screen is bent is acquired, the initial distance is taken as the second are length, and a circle equation of the curved surface where the first infrared module and the second infrared module are located is acquired via the second arc length, the second chord length and the first coordinates.

Specifically, an initial distance between the first infrared module C and the second infrared module D before the display screen is bent may be acquired via these two infrared modules C and D in advance, and the initial distance is taken as the second arc length.

Next, the second arc length and the second chord length are substituted into the formula (1) to acquire r.

Then, a circle equation is acquired. A circle formula is as follows:

$$\begin{cases} x = m + r * \cos\theta \\ y = n + r * \sin\theta \end{cases} \tag{2}$$

(m, n) is a coordinate of the center of the circle where the curved surface is located.

A relation between y and x, i.e., the circle equation y=f(x), may be derived according to formula (2), and the formula includes unknowns m and n. Since 'cos $\theta^2$+sin $\theta^2$=1, formula (2) may be derived as follows:

$$\left(\frac{x-m}{r}\right)^2 + \left(\frac{y-n}{r}\right)^2 = 1 \tag{3}$$

By substituting the first coordinate of the first infrared module C', the first coordinate of the second infrared module D' and r into formula (3), values of m and n may be acquired via calculation, and finally the relational expression y=f (x) of the circle equation is acquired.

In step 2044, a second coordinate of the first light-emitting diode and a second coordinate of the second light-emitting diode in the rectangular coordinate system are acquired via the circle equation.

The second coordinate of the first light-emitting diode and the second coordinate of the second light-emitting diode in the rectangular coordinate system are acquired via the circle equation.

In this embodiment, it is preferable that a spacing of any two adjacent light-emitting diodes is equal, and the second coordinate of the first light-emitting diode and the second coordinate of the second light-emitting diode on the curved surface in the rectangular coordinate system are acquired via the circle equation.

Specifically, since the spacing of any two adjacent light-emitting diodes is equal, an x coordinate of the first light-emitting diode P and an x coordinate of the second light-emitting diode Q in the rectangular coordinate system, which are $x_1$ and $x_2$ respectively, may be acquired via the coordinate of the first infrared module C' and the coordinate of the second infrared module D' in the rectangular coordinate system and the spacing.

A y coordinate of the first light-emitting diode P and a y coordinate of the second light-emitting diode Q in the rectangular coordinate system are acquired via the x coordinate of the first light-emitting diode and the x coordinate of the second light-emitting diode in the rectangular coordinate system and the circle equation.

Specifically, $x_1$ and $x_2$ are respectively substituted into the relation expression y=f(x) of the circle equation to acquire the respective y coordinates, i.e., $y_1$ and $y_2$.

In step 2045, the target distance is acquired.

This step is to calculate the target distance according to the second coordinate.

The target distance between the first light-emitting diode P and the second light-emitting diode Q is acquired via the coordinate of the first light-emitting diode P and the coordinate of the second light-emitting diode Q in a rectangular coordinate system.

Specifically, the coordinate of P ($x_1$, $y_1$) and the coordinate of Q ($x_2$, $y_2$) are substituted into formula (4) to acquire the target distance d:

$$\begin{cases} k = \dfrac{(y_1 - y_2)}{(x_1 - x_2)} \\ d = |x_1 - x_2|(k^2 + 1)^{1/2} \end{cases} \quad (4)$$

In step 205, the display screen is controlled to perform split-screen display.

A placing direction of the display screen is acquired via a gravity sensor. The display screen is divided into a first split screen and a second split screen in the placing direction. The first split screen is set as a primary screen and the second split screen is set as a secondary screen.

In this embodiment, if the display screen is placed in a landscape orientation and bent along a longitudinal axis, the left screen is the first split screen and the right screen is the second split screen. The first split screen is set as the primary screen to display a current application program and the second split screen is set as a secondary screen to display a second application program in the process.

If the display screen is bent along a transverse axis, the upper screen is the first split screen and the lower screen is the second split screen. The first split screen is set as the primary screen to display the current application program and the second split screen is set as the secondary screen to display the second application program in the process.

When the display screen is placed in a portrait orientation, a screen splitting processing is also performed according to the screen splitting manner as described above.

In step 206, it is detected whether there is a target light-emitting diode on the display screen.

It is detected whether there is a target light-emitting diode on the display screen where a distance between the target light-emitting diode and the first light-emitting diode before the display screen is bent is the target distance.

In this embodiment, it is detected whether there is the target light-emitting diode on the display screen where the distance between the target light-emitting diode and the first light-emitting diode P before the display screen is bent is the target distance. If there no target light-emitting diode on the display screen, step 207 is implemented. If there is the target light-emitting diode on the display screen, the second light-emitting diode Q is kept emitting light normally to display.

In step 207, the second light-emitting diode is turned off.

In this embodiment, the second light-emitting diode Q is turned off.

In this embodiment, the display control method for the display screen is to turn off some of the diodes when the bending angle is greater than the preset value, so as to keep a display image on the display screen consistent before and after the display screen is bent without a partial stretch or contraction, thereby improving user experience. When the bending angle is not greater than the preset value, the control display screen is controlled to perform split-screen display, thereby enabling the normal use of the control display screen, and improving the flexibility.

A Third Embodiment

Figure 5:
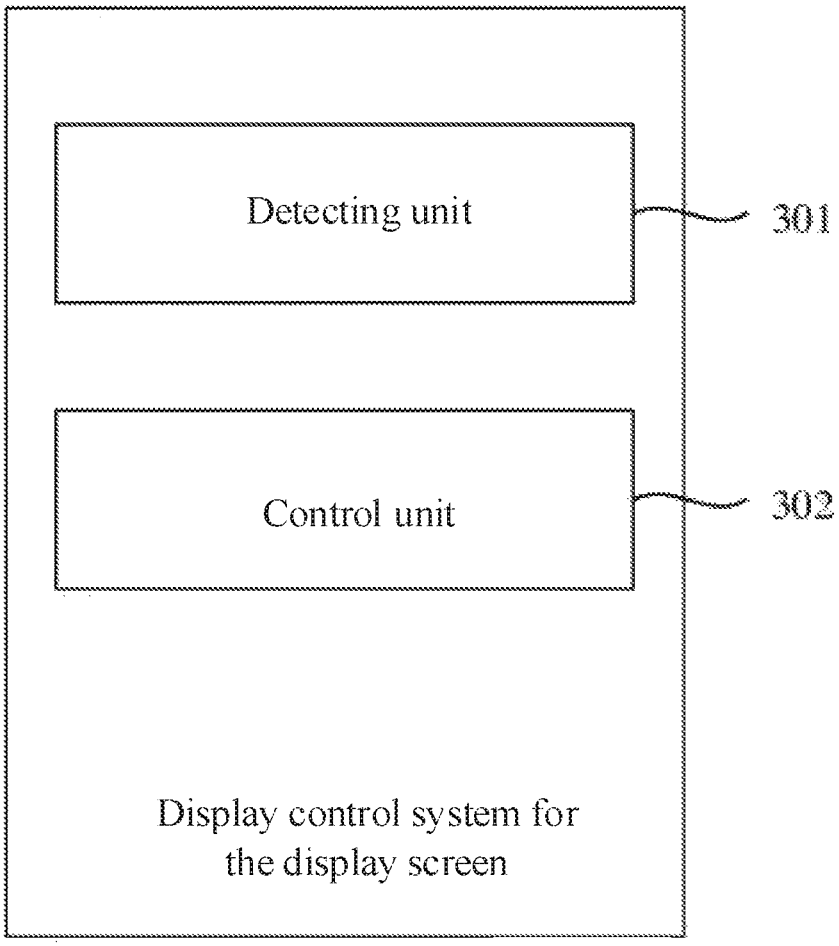
FIG. 5 is a schematic structural diagram of a display control system for a display screen according to a third embodiment of the present disclosure.

FIG. 5 shows a schematic structural diagram of a display control system for a display screen according to this embodiment, and the display screen is a flexible display screen provided with multiple light-emitting diodes. The display control system for the display screen includes a detecting unit 301 and a control unit 302.

The detecting unit 301 is configured to detect whether the display screen is bent when all the multiple light-emitting diodes emit light to display, and call the control unit 302 if the display screen is bent and keep the light-emitting diodes normally emitting light if the display screen is not bent.

The control unit 302 is configured to turn off some of the light-emitting diodes to keep a display image consistent before and after the display screen is bent.

In this embodiment, the display control system for the display screen is to turn off some of the diodes to keep the display image on the display screen consistent before and after the display screen is bent without a partial stretch or contraction, thereby improving user experience.

A Fourth Embodiment

Figure 6:
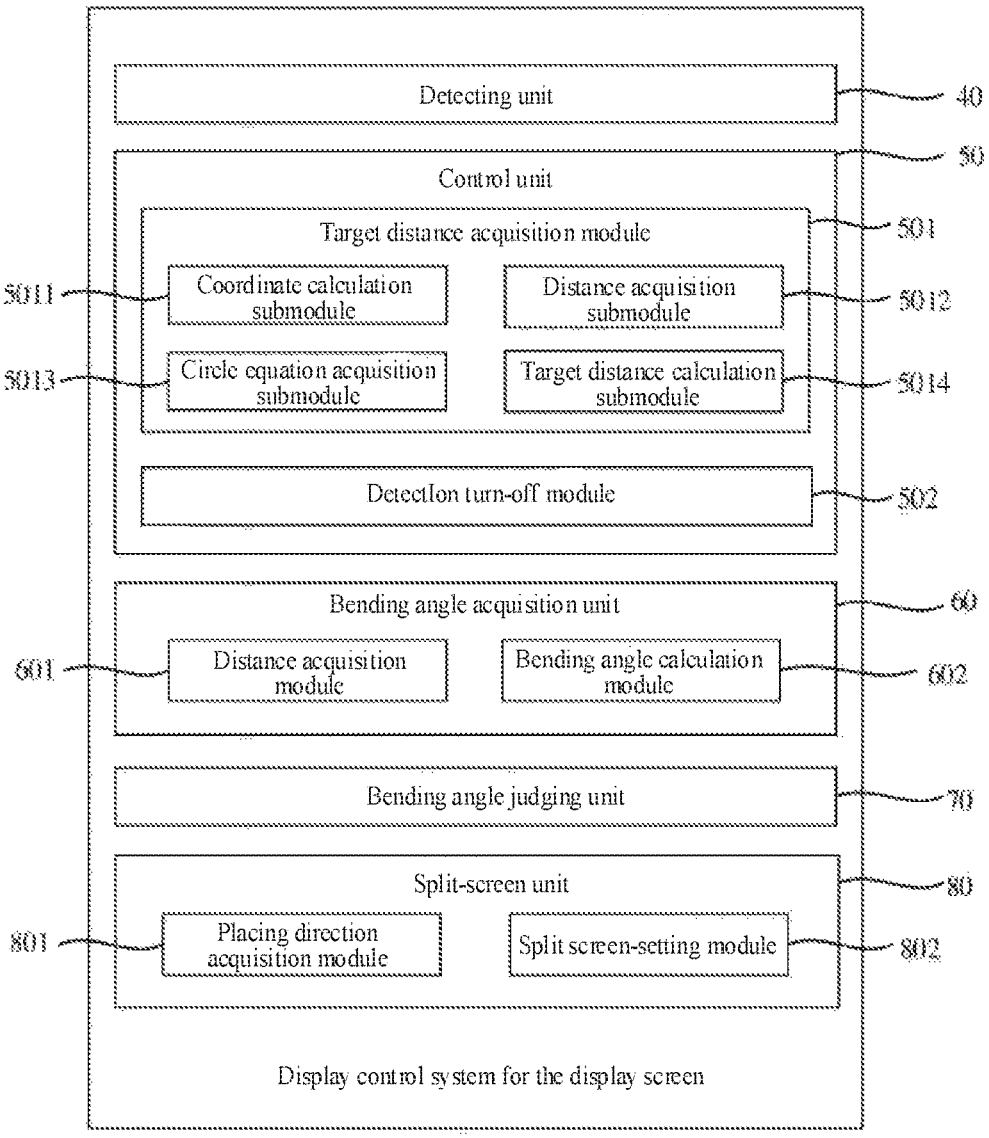
FIG. 6 is a schematic structural diagram of a display control system for a display screen according to a fourth embodiment of the present disclosure.

FIG. 6 shows a schematic structural diagram of a display control system for a display screen according to this embodiment. The display screen is a flexible display screen provided with multiple light-emitting diodes.

In this embodiment, the display control system for the display screen includes a detecting unit 40, a control unit 50, a bending angle acquisition unit 60, a bending angle judging unit 70, and a split-screen unit 80.

The detecting unit 40 is configured to detect whether the display screen is bent when all the multiple light-emitting diodes emit light to display, and call the control unit if the display screen is bent.

The flexible display screen is provided with multiple light-emitting diodes, and an initial state of the display screen is horizontal. The detecting unit 40 judges whether the display screen is bent via a pressure sensor provided on the display screen. Specifically, the pressure sensor judges whether the display screen is bent by sensing a pressure of each position point on the display screen. If the display screen is not bent, the light-emitting diodes are kept emitting light normally to display.

The control unit 50 is configured to turn off some of the light-emitting diodes, so as to keep a display image on the display screen consistent before and after the display screen is bent.

Two infrared modules are disposed at two opposite edges of the display screen, and a line direction of the two infrared modules is identical with a bending direction of the display screen.

The display control system for the display screen further includes the bending angle acquisition unit 60 and the bending angle judging unit 70.

The display control system for the display screen calls the bending angle acquisition unit 60 after the display control system for the display screen calls the detecting unit 40 and before the display control system for the display screen calls the control unit 50. The bending angle acquisition unit 60 is configured to calculate a bending angle of the display screen via the two infrared modules.

The bending angle acquisition unit 60 includes a distance acquisition module 601 and a bending angle calculation module 602.

The distance acquisition module 601 is configured to acquire a first distance between the two infrared modules before the display screen is bent.

The distance acquisition module 601 is further configured to acquire a second distance between the two infrared modules after the display screen is bent.

The bending angle calculation module 602 is configured to calculate the bending angle of the display screen by taking the first distance as a first arc length and the second distance as a first chord length.

Specifically, as shown in FIG. 4*a*, five infrared modules, A, B, C, D and E, are disposed on the display screen before the display screen is bent, where A and E are two infrared modules disposed at two opposite edges. In this embodiment, multiple infrared modules are disposed equidistantly in the line direction of the two infrared modules disposed at the two opposite edges. Therefore, the five infrared modules are respectively disposed at the left edge, the middle portion of the left half, the center portion, the middle portion of the right half, and the right edge of the display screen and are on the same straight line.

In this embodiment, the bending angle of the display screen is acquired by the infrared modules A and E.

Specifically, as shown in FIGS. 4*a* and 4*b*, it should be explained in advance that the five infrared modules A', B', C', D' and E' shown in FIG. 4*b* are respectively corresponding to the five infrared modules A, B, C, D and E after the display screen is bent.

The distance acquisition module 601 is configured to respectively acquire a first distance between the infrared modules A and E before the display screen is bent and a second distance between the infrared modules A' and E' after the display screen is bent via the infrared modules A and E.

The bending angle calculation module 602 is configured to calculate the bending angle of the display screen by taking the first distance as a first arc length and the second distance as a first chord length.

The first arc length is defined as 1, the first chord length is defined as a, and the bending angle θ is calculated according to formula (1).

Herein, r is the radius of the circle where the first arc length is located.

$$\begin{cases} \sin\frac{\theta}{2} = \frac{a/2}{r} \\ 1 = \theta r \end{cases} \tag{1}$$

The bending angle judging unit 70 is configured to judge whether the bending angle is greater than a preset value, and call the control unit 50 if the bending angle is greater than a preset value.

In this embodiment, a preset value is 130°. If the bending angle is greater than 130°, the control unit 50 is called, and if the bending angle is less than or equal to 130°, the split-screen unit 80 is called.

The control unit 50 includes a target distance acquisition module 501 and a detection turn-off module 502.

The target distance acquisition module 501 is configured to acquire a target distance between a first light-emitting diode and a second light-emitting diode that are located between a first infrared module and a second infrared module.

The first infrared module and the second infrared module are any two infrared modules on the display screen. The first light-emitting diode and the second light-emitting diode are any two light-emitting diodes between the first infrared module and the second infrared module.

The target distance acquisition module 501 includes a coordinate calculation submodule 5011, a distance acquisition submodule 5012, a circle equation acquisition submodule 5013, and a target distance calculation submodule 5014.

The coordinate calculation submodule 5011 is configured to establish a rectangular coordinate system.

An x-axis is a straight line connecting the first infrared module and the second infrared module before the display screen is bent, and a y-axis is a straight line perpendicular to the display screen, and an origin is the first infrared module before the display is bent.

As shown in FIG. 4*a* and FIG. 4*b*, in this embodiment, C and D are selected as the first infrared module and the second infrared module. It is supposed that there are any two light-emitting diodes between the first infrared module C and the second infrared module D, P is the first light-emitting diode, and Q is the second light-emitting diode.

Since the first light-emitting diode P and the second light-emitting diode Q are located on a curved surface where the first infrared module C' and the second infrared module D' are located, the x-axis is a straight line connecting the first infrared module C and the second infrared module D before the display screen is bent, the y-axis is the straight line perpendicular to the display screen, and the origin is the first infrared module C before the display screen is bent.

The coordinate calculation submodule 5011 is further configured to acquire a first coordinate of the first infrared module and a first coordinate of the second infrared module in the rectangular coordinate system, that is, to acquire the first coordinate of the first infrared module C' and the second infrared module D' in the rectangular coordinate system after the display screen is bent.

Since the first infrared module C is the origin of the rectangular coordinate system and the first infrared module C' is set on the y-axis, the first coordinate of the first infrared module C' may be acquired.

A plane before the display screen is bent is taken as a reference plane, to acquire heights of the first infrared module C' and the second infrared module D' relative to the reference plane.

Therefore, an abscissa of the first infrared module C' is 0, and an ordinate of the first infrared module C' is the height of the first infrared module C' relative to the reference plane.

Then a height difference between the first infrared module C' and the second infrared module D' is acquired according to the height.

The distance acquisition submodule 5012 is configured to acquire a final distance between the first infrared module and the second infrared module after the display screen is bent.

A final distance between the first infrared module C' and the second infrared module D' after the display screen is bent may be acquired via these two infrared modules C' and D'. The final distance is taken as a second chord length.

The height difference is taken as a right-angle edge and the second chord length is taken as a bevel edge to acquire a length of the other right-angle edge, i.e., a distance of the second infrared module D' from the y-axis. The first coordinate of the second infrared module D' may be acquired according to the rectangular coordinate system, and x coordinate is the distance of the second infrared module D' from the y-axis, and y coordinate is the height of the second infrared module D' relative to the reference plane.

The distance acquisition submodule 5012 is further configured to acquire an initial distance between the first infrared module and the second infrared module before the display screen is bent. The initial distance is taken as a second arc length.

The circle equation acquisition submodule 5013 is configured to acquire a circle equation of the curved surface where the first infrared module and the second infrared module are located, i.e., to acquire the circle equation of the curved surface where the first infrared module C' and the second infrared module D' are located, via the second arc length, the second chord length and the first coordinates.

Specifically, an initial distance between the first infrared module C and the second infrared module D before the display screen is bent may be acquired via these two infrared modules C and D in advance, and the initial distance is taken as the second arc length.

Next, the second arc length and the second chord length are substituted into the formula (1) to acquire r.

Then, a circle equation is acquired. A circle formula is as follows:

$$\begin{cases} x = m + r * \cos\theta \\ y = n + r * \sin\theta \end{cases} \tag{2}$$

(m, n) is a coordinate of the center of the circle where the curved surface is located.

A relation between y and x, i.e., the circle equation y=f (x), may be derived according to formula (2), and the formula includes unknowns m and n. Since 'cos $\theta^2$+sin $\theta^2$=1, formula (2) may be derived as follows:

$$\left(\frac{x-m}{r}\right)^2 + \left(\frac{y-n}{r}\right)^2 = 1 \tag{3}$$

By substituting the first coordinate of the first infrared module C', the first coordinate of the second infrared module D' and r into formula (3), values of m and n may be acquired via calculation, and finally the relational expression y=f (x) of the circle equation is acquired.

The coordinate calculation submodule 5011 is further configured to acquire a second coordinate of the first light-emitting diode and a second coordinate of the second light-emitting diode in the rectangular coordinate system via the circle equation.

In this embodiment, it is preferable that a spacing of any two adjacent light-emitting diodes is equal, and the second coordinate of the first light-emitting diode and the second coordinate of the second light-emitting diode on the curved surface in the rectangular coordinate system are acquired via the circle equation.

Specifically, since the spacing of any two adjacent light-emitting diodes is equal, an x coordinate of the first light-emitting diode P and an x coordinate of the second light-emitting diode Q in the rectangular coordinate system, which are $x_1$ and $x_2$ respectively, may be acquired via the coordinate of the first infrared module C' and the coordinate of the second infrared module D' in the rectangular coordinate system and the spacing.

A y coordinate of the first light-emitting diode P and a y coordinate of the second light-emitting diode Q in the rectangular coordinate system are acquired via the x coordinate of the first light-emitting diode P and the second light-emitting diode Q in the rectangular coordinate system and the circle equation.

That is, $x_1$ and $x_2$ are respectively substituted into the relational equation y=f(x) of the circle equation to acquire the respective y coordinates, i.e., $y_1$ and $y_2$.

The target distance calculation submodule 5014 is configured to calculate the target distance according to the second coordinate.

The target distance between the first light-emitting diode P and the second light-emitting diode Q is acquired via the coordinate of the first light-emitting diode P and the coordinate of the second light-emitting diode Q in the rectangular coordinate system.

Specifically, the coordinate of p ($x_1$, $y_1$) and the coordinate of q ($x_2$, $y_2$) are substituted into formula (4) to acquire the target distance d:

$$\begin{cases} k = \dfrac{(y_1 - y_2)}{(x_1 - x_2)} \\ d = |x_1 - x_2|(k^2 + 1)^{1/2} \end{cases} \tag{4}$$

The detection turn-off module 502 is configured to detect whether there is a target light-emitting diode on the display screen, and a distance between the target light-emitting diode and the first light-emitting diode before the display screen is bent is the target distance. If there is no target light-emitting diode, the second light-emitting diode is turned off.

In this embodiment, it is detected whether there is the target light-emitting diode on the display screen. A distance between the target light-emitting diode and the infrared module E' before the display screen is bent is the target distance. If there is no target light-emitting diode on the display screen, the second light-emitting diode Q is turned off. If there is the target light-emitting diode on the display screen, the second light-emitting diode Q is kept emitting light normally to display.

The split-screen unit 80 is configured to control the display screen to perform split-screen display.

The split-screen unit 80 includes a placing direction acquisition module 801 and a split-screen setting module 802. The placing direction acquisition module 801 is configured to acquire a placing direction of the display screen via a gravity sensor.

The split-screen setting module 802 is configured to divide the display screen into a first split screen and a second split screen in the placing direction. The split-screen setting module 802 is further configured to set the first split screen as a primary screen and the second split screen as a secondary screen.

In this embodiment, if the display screen is placed in a landscape orientation and bent along the longitudinal axis, the left screen is the first split screen and the right screen is the second split screen. The first split screen is set as the primary screen to display a current application program and the second split screen is set as a secondary screen to display a second application program in process.

If the display screen is bent along a transverse axis, the upper screen is the first split screen and the lower screen is the second split screen. The first split screen is set as the primary screen to display the current application program and the second split screen is set as the secondary screen to display the second application program in the process.

When the display screen is placed in a portrait orientation, a screen splitting processing is also performed according to the screen splitting manner as described above.

In this embodiment, the display control system for the display screen is to turnoff some of the diodes, so as to keep the display image consistent before and after the display screen is bent without a partial stretch or contraction, thereby improving user experience. When the bending angle is not greater than the preset value, the control display screen is controlled to perform split-screen display, thereby enabling the normal use of the control display screen and improving the flexibility.

Persons of ordinary skill in the art may understand that all or some of the steps of the embodiments may be implemented by hardware or a program instructing related hardware. The program may be stored in a computer-readable storage medium, and a processor may be used to execute the program. The storage medium may include: a read-only memory, a magnetic disk, or an optical disc.

Those skilled in the art should understand that the above embodiments are only specific embodiments for implementing the present disclosure, and the protection scope of the present disclosure is defined by the appended claims. Those skilled in the art may make various changes or modifications to the embodiments without departing from the principles and spirit of the present disclosure, and such changes and modifications fall within the protection scope of the present disclosure.

What is claimed is:

1. A display control method for a display screen, wherein the display screen is a flexible display screen with multiple light-emitting diodes, the display control method for the display screen comprising steps of:

detecting whether the display screen is bent when all the multiple light-emitting diodes emit light to display, and turning off some of the light-emitting diodes to keep a display image consistent before and after the display screen is bent when the display screen is bent;

wherein two infrared modules are disposed at two opposite edges of the display screen, and a line direction of the two infrared modules is identical with a bending direction of the display screen; and after the step of detecting that the display screen is bent and before the step of turning off some of the light-emitting diodes, the display control method further comprises steps of:

calculating a bending angle of the display screen via the two infrared modules; and judging whether the bending angle is greater than a preset value, and executing the step of turning off some of the light-emitting diodes when the bending angle is greater than the preset value;

wherein the display screen is further provided with multiple infrared modules in the line direction of the two infrared modules; and the step of turning off some of the light-emitting diodes comprises steps of:

acquiring a target distance between a first light-emitting diode and a second light-emitting diode that are located between a first infrared module and a second infrared module; and detecting whether there is a target light-emitting diode on the display screen, and turning off the second light-emitting diode when there is no target light-emitting diode on the display screen, wherein a distance between the target light-emitting diode and the first light-emitting diode before the display screen is bent is the target distance;

wherein the first infrared module and the second infrared module are any two infrared modules on the display screen; and wherein the first light-emitting diode and the second light-emitting diode are any two light-emitting diodes between the first infrared module and the second infrared module.

2. The display control method for the display screen according to claim 1, wherein the step of calculating the bending angle of the display screen comprises:

acquiring a first distance between the two infrared modules before the display screen is bent;

acquiring a second distance between the two infrared modules after the display screen is bent; and calculating the bending angle of the display screen by taking the first distance as a first arc length and the second distance as a first chord length.

3. The display control method for the display screen according to claim 1, wherein the step of acquiring the target distance between the first light-emitting diode and the second light-emitting diode comprises steps of:

establishing a rectangular coordinate system;

acquiring a first coordinate of the first infrared module and a first coordinate of the second infrared module in the rectangular coordinate system, an initial distance before the display screen is bent, and a final distance after the display screen is bent;

acquiring a circle equation of a curved surface where the first infrared module and the second infrared module are located, via the initial distance which is taken as a second arc length, the final distance which is taken as a second chord length and the first coordinates;

acquiring a second coordinate of the first light-emitting diode and a second coordinate of the second light-emitting diode in the rectangular coordinate system via the circle equation; and calculating the target distance according to the second coordinates.

4. The display control method for the display screen according to claim 1, further comprising a step of:

controlling the display screen to perform split-screen display when the bending angle of the display screen is not greater than the preset value.

5. The display control method for the display screen according to claim 4, wherein the step of controlling the display screen to perform split-screen display comprises steps of:

acquiring a placing direction of the display screen via a gravity sensor;

dividing the display screen into a first split screen and a second split screen in the placing direction; and setting the first split screen as a primary screen and the second split screen as a secondary screen.

6. A display control system for a display screen, wherein the display screen is a flexible display screen provided with multiple light-emitting diodes, and the display control system for the display screen comprises a detecting unit and a control unit;

the detecting unit is configured to detect whether the display screen is bent when all the multiple light-emitting diodes emit light to display, and call the control unit if the display screen is bent; and the control unit is configured to turn off some of the light-emitting diodes to keep a display image consistent before and after the display screen is bent;

wherein two infrared modules are disposed at two opposite edges of the display screen, and a line direction of the two infrared modules is identical with a bending direction of the display screen; and the display control system for the display screen further comprises a bending angle acquisition unit and a bending angle judging unit;

wherein the bending angle acquisition unit is called after the display control system for the display screen calls the detecting unit and before the display control system for the display screen calls the control unit;

the bending angle acquisition unit is configured to calculate the bending angle of the display screen via the two infrared modules; and the bending angle judging unit is configured to judge whether the bending angle is greater than a preset value, and call the control unit if the bending angle is greater than a preset value;

wherein the display screen is further provided with multiple infrared modules in the line direction of the two infrared modules; and the control unit comprises a target distance acquisition module and a detection turn-off module;

the target distance acquisition module is configured to acquire a target distance between a first light-emitting diode and a second light-emitting diode that are located between a first infrared module and a second infrared module; and the detection turn-off module is configured to detect whether there is a target light-emitting diode on the display screen, and turn off the second light-emitting diode when there is no target light-emitting diode on the display screen, wherein a distance between the target light-emitting diode and the first light-emitting diode before the display screen is bent is the target distance;

wherein the first infrared module and the second infrared module are any two infrared modules on the display screen; and the first light-emitting diode and the second light-emitting diode are any two light-emitting diodes between the first infrared module and the second infrared module.

7. The display control system for the display screen according to claim 6, wherein the bending angle acquisition unit comprises a distance acquisition module and a bending angle calculation module;

the distance acquisition module is configured to acquire a first distance between the two infrared modules before the display screen is bent;

the distance acquisition module is further configured to acquire a second distance between the two infrared modules after the display screen is bent; and the bending angle calculation module is configured to calculate a bending angle of the display screen by taking the first distance as a first arc length and the second distance as a first chord length.

8. The display control system for the display screen according to claim 6, wherein the target distance acquisition module comprises a coordinate calculation submodule, a distance acquisition submodule, a circle equation acquisition submodule, and a target distance calculation submodule;

the coordinate calculation submodule is configured to establish a rectangular coordinate system;

the coordinate calculation submodule is further configured to acquire a first coordinate of the first infrared module and a first coordinate of the second infrared module in the rectangular coordinate system;

the distance acquisition submodule is configured to acquire an initial distance between the first infrared module and the second infrared module before the display screen is bent and a final distance after the display screen is bent;

the circle equation acquisition submodule is configured to acquire a circle equation of a curved surface where the first infrared module and the second infrared module are located via the initial distance which is taken as a second arc length, the final distance which is taken as a second chord length and the first coordinates;

the coordinate calculation submodule is further configured to acquire a second coordinate of the first light-emitting diode and a second coordinate of the second light-emitting diode in the rectangular coordinate system via the circle equation; and the target distance calculation submodule is configured to calculate the target distance according to the second coordinates.

9. The display control system for the display screen according to claim 6, wherein the display control system for the display screen further comprises a split-screen unit;

the bending angle judging unit is further configured to call the split-screen unit if the bending angle of the display screen is not greater than the preset value; and the split-screen unit is configured to control the display screen to perform split-screen display.

10. The display control system for the display screen according to claim 9, wherein the split-screen unit comprises a placing direction acquisition module and a split-screen setting module;

the placing direction acquisition module is configured to acquire a placing direction of the display screen via a gravity sensor;

the split-screen setting module is configured to divide the display screen into a first split screen and a second split screen in the placing direction; and the split-screen setting module is further configured to set the first split screen as a primary screen and the second split screen as a secondary screen.

* * * * *